US005394650A

United States Patent [19]

Dean

[11] Patent Number: 5,394,650

[45] Date of Patent: Mar. 7, 1995

[54] MANWAY COVER BALANCING MECHANISM

[75] Inventor: Robert H. Dean, Evanston, Ill.

[73] Assignee: Midland Manufacturing Corp., Skokie, Ill.

[21] Appl. No.: 185,130

[22] Filed: Jan. 24, 1994

[51] Int. Cl.[6] ..... E05F 1/10

[52] U.S. Cl. ..... 49/386; 16/308; 52/20

[58] Field of Search ..... 49/386, 379; 16/1 C, 16/308; 52/20, 19

[56] References Cited

U.S. PATENT DOCUMENTS

| | | | |
|---|---|---|---|
| 736,714 | 8/1903 | Gendron . | |
| 823,372 | 6/1906 | Stevens et al. . | |
| 1,801,840 | 4/1931 | Banfield . | |
| 2,587,287 | 2/1952 | Chamberlain . | |
| 3,712,248 | 1/1973 | Floehr . | |
| 3,714,680 | 2/1973 | Little . | |
| 4,137,669 | 2/1979 | Nunlist . | |
| 4,534,132 | 8/1985 | Smith . | |
| 4,537,233 | 8/1985 | Vroonland et al. | 16/308 X |
| 4,828,236 | 5/1989 | Inoue . | |
| 5,037,231 | 8/1991 | Kitamura | 16/308 X |
| 5,038,520 | 8/1991 | Amorese et al. . | |
| 5,136,811 | 8/1992 | Lyons, Sr. . | |
| 5,184,422 | 2/1993 | Wade et al. . | |

OTHER PUBLICATIONS

Midland Manufacturing Corp. Drawing No. B305, B306.

*Primary Examiner*—Jerry Redman
*Attorney, Agent, or Firm*—Emrich & Dithmar

[57] ABSTRACT

A manway is defined by a cylindrical portion of a vessel wall and is closed by a cover pivotally movable between open and closed positions by means of a hinge mechanism including external brackets on the cover and the wall portion interconnected by a hinge pin. The opposite ends of the hinge pin carry bushings, on which are respectively disposed two torsion springs. Each spring has a vessel wall end portion disposed parallel to the hinge pin, the vessel wall end portions being respectively received in the opposite ends of a coupling sleeve engageable with bearing surfaces on one of the brackets. The other ends of the two torsion springs are respectively disposed generally perpendicular to the hinge pin and are received slidably through eyebolts fixed to the cover bracket.

15 Claims, 2 Drawing Sheets

MANWAY COVER BALANCING MECHANISM

BACKGROUND OF THE INVENTION

1. Field of the Invention

This invention relates to a cover for a manhole or manway which provides access to an enclosed space, such as a tank, or other type of storage vessel. In particular, the invention relates to mechanisms for balancing the weight of the cover to assist in manual movement of same between open and closed positions.

2. Description of the Prior Art

Operating procedures for tank cars and other types of tank vessels commonly require that operating personnel not be required to lift in excess of a predetermined weight, e.g., 50 pounds. Hinged manway covers for such vessels typically weigh in excess of 100 pounds. Thus, the lifting force required at the handle to open the manway cover typically exceeds the allowable maximum lifting weight. Accordingly, it is known to provide such manway covers with balancing or lifting assisting mechanisms to provide a spring-biased assist to the operating personnel.

One such arrangement is made and sold by Midland Manufacturing Corp. and includes a pair of torsion springs mounted on opposite ends of the cover hinge pin. Each torsion spring has one end thereof received through an opening in the portion of the vessel wall defining the manway, and the other end thereof disposed through an eyebolt which is fixed through an opening in the manway cover. While this arrangement works well, it cannot be used with pressurized vessels because of the proscription against drilling holes in the cover or in the vessel wall which defines the manway. Standard operating procedures typically prohibit forming holes through or welding directly to a pressurized vessel wall.

Balancing mechanisms which are mounted entirely externally of the manway and the cover have been provided and are disclosed, for example, in U.S. Pat. Nos. 4,137,669 and 4,038,520. But both of these mechanisms are quite complex and consume a considerable amount of space, projecting a substantial distance radially from the manway.

SUMMARY OF THE INVENTION

It is a general object of the invention to provide an improved balancing mechanism for a manway cover which avoids the disadvantages of prior balancing mechanisms while affording additional structural and operating advantages.

An important feature of the invention is the provision of a balancing mechanism for a manway cover which is mounted entirely externally of the manway and the cover and does not require the formation of holes in or the welding directly to either the cover or the manhole-defining wall or manway.

In connection with the foregoing feature, another feature of the invention is the provision of a balancing mechanism of the type set forth which can readily be retrofitted to existing pressurized vessel manway covers.

Still another feature of the invention is the provision of a balancing mechanism of the type set forth which is of simple and economical construction.

Yet another feature of the invention is the provision of a balancing mechanism of the type set forth which is compact and does not extend substantially beyond the outlines of the existing manway and cover.

These and other features of the invention are attained by providing a balancing mechanism for a cover for a manway defined by a portion of a pressurized vessel wall, wherein the cover is pivotally mounted for movement between open and closed positions relative to the manway by externally mounted hinge structure which includes a hinge pin coupling external first and second hinge brackets respectively on the cover and the wall portion, the balancing mechanism comprising: torsion spring mechanism carried the hinge structure and having first and second end structures, first coupling mechanism disposed externally of the manway and the cover and cooperating with one of the end structures and with the first hinge bracket to cause the one end structure and the cover to move together, and second coupling mechanism disposed externally of the manway and the cover and cooperating with the other of the end structures and with the second hinge bracket effectively to prevent movement of the other end structure in response to movement of the cover, the torsion spring mechanism being oriented so as to resiliently urge the cover toward the open position thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
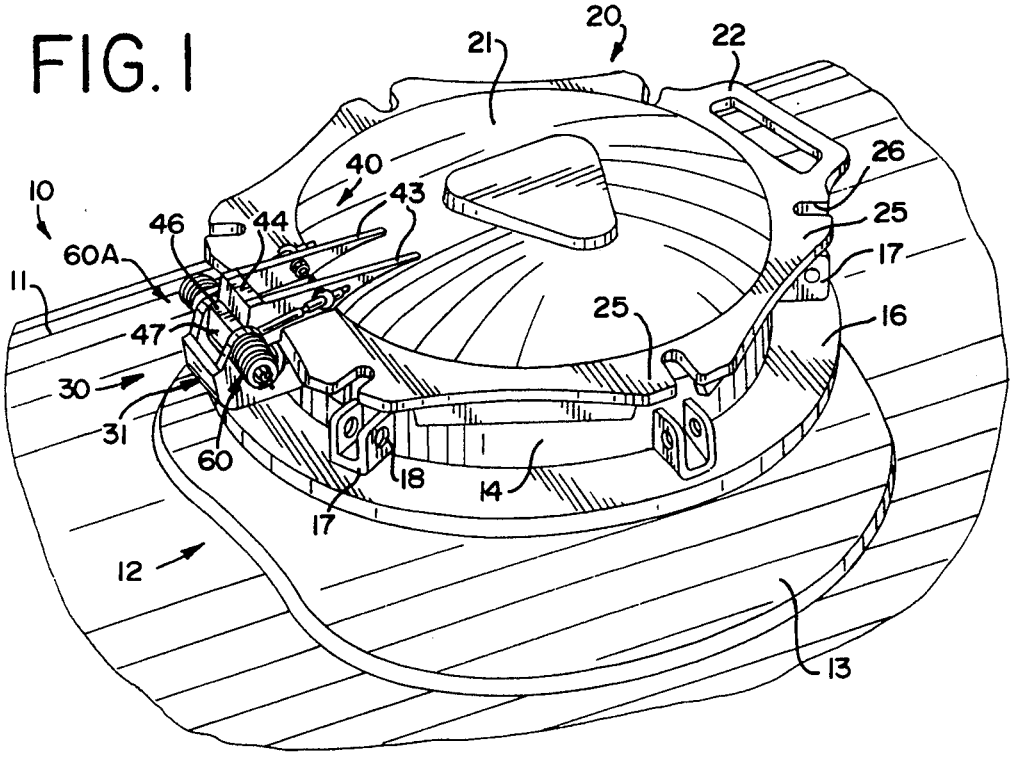
FIG. 1 is a perspective view of a manway cover disposed in its closed position relative to a manway in a fragmentarily-illustrated vessel, and incorporating a balancing mechanism in accordance with the present invention.
Figure 2:
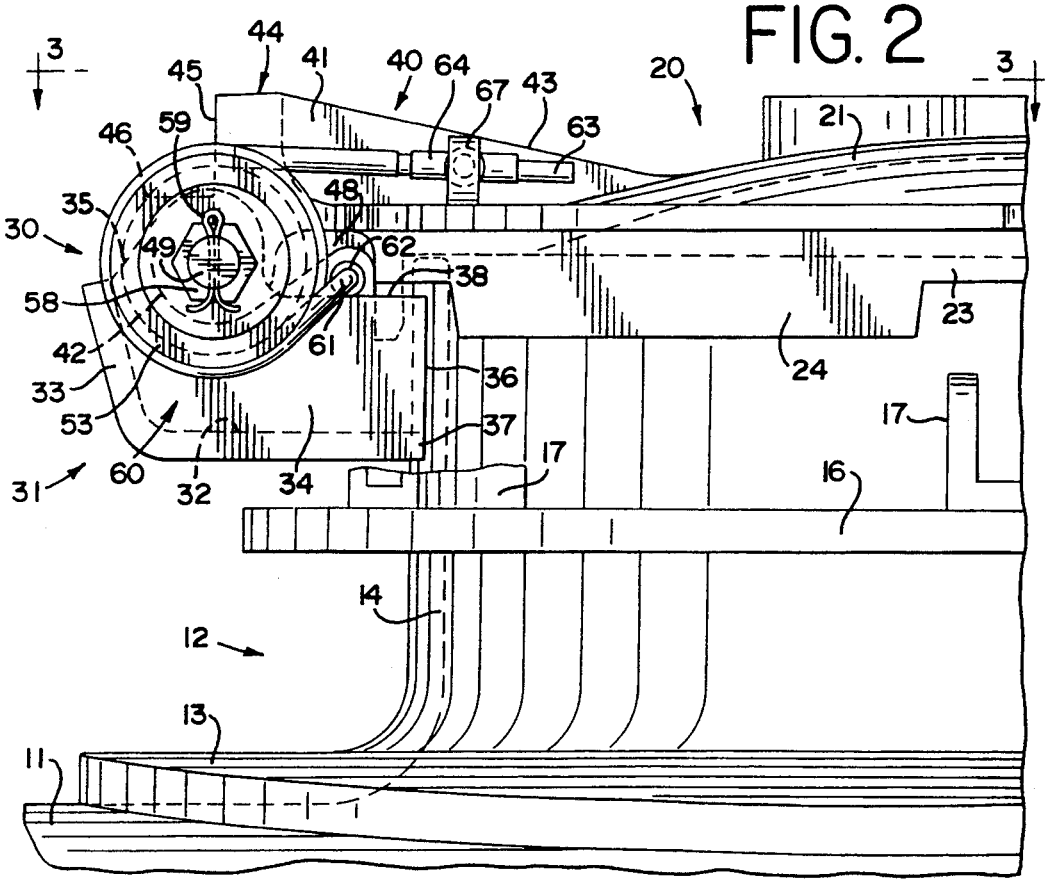
FIG. 2 is an enlarged, fragmentary, side elevational view of the balancing mechanism of FIG. 1.
Figure 3:
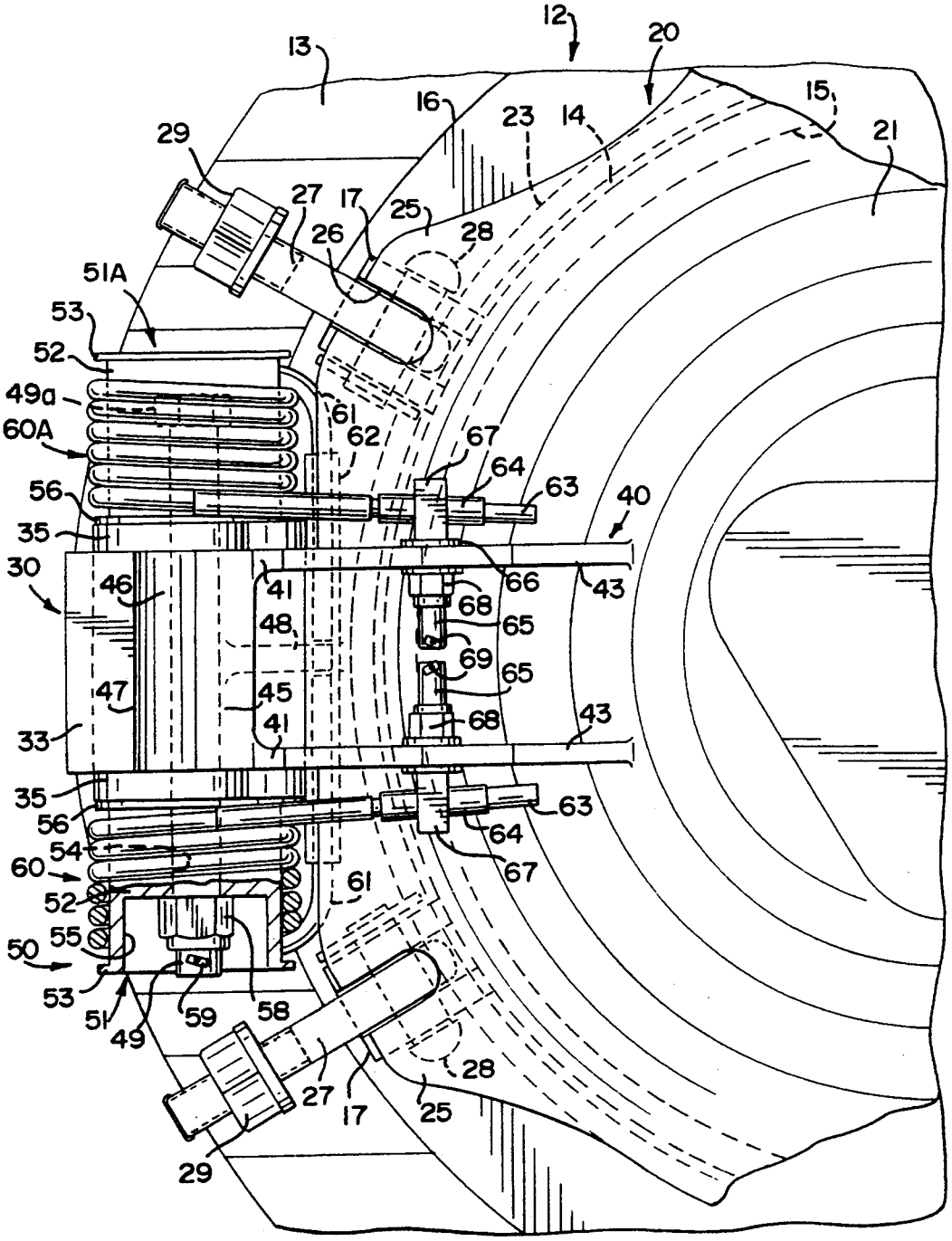
FIG. 3 is a fragmentary top plan view taken along the line 3—3 in FIG. 2.

Referring to FIGS. 1–3, there is illustrated a portion of a storage vessel 10 defined by a wall 11. The vessel 10 may be of any of a number of different types of tanks, such as that used in a railway tank car, and is preferably of the pressurized type designed for storing the contents thereof under superatmospheric pressure. The vessel 10 is provided with a manway structure 12 which includes a saddle 13 fixedly secured to the vessel wall 11, as by welding, and including an upstanding cylindrical wall 14 which cooperates with an aligned opening in the vessel wall 11 to define a manway 15 (see FIG. 3) in a known manner. The cylindrical wall 14 may be provided with a radially outwardly extending annular flange 16 midway between the upper and lower ends thereof. Fixedly secured to the outer surface of the cylindrical wall 14 at equiangularly spaced apart locations thereon and just above the flange 16 are a plurality of inverted U-shaped hold-down brackets 17, each having aligned bores 18 through the legs thereof.

The manway 15 is provided with a cover 20 which includes a circular, slightly domed wall 21 provided with a radially outwardly projecting handle 22 extending from the wall 21. Coaxially therewith is a cylindrical flange 23 having a plurality of spaced-apart axially extending projections 24, the flange 23 having an inner diameter very slightly greater than the outer diameter of the cylindrical wall 14 of the manway structure 12 and adapted to be telescopically received thereover. The cover wall 21 has a plurality of equiangularly spaced-apart and radially outwardly extending lobes 25, each having a slot 26 formed therein. The lobes 25 are arranged so as to be respectively vertically aligned with the hold-down brackets 17. Mountable in the hold-down brackets 17 are a plurality of hold-down lugs 27 in-the form of eyebolts, each having one end fixed to a pivot pin 28 extending through the aligned bores 18 in the associated bracket 17 and being externally threaded at the other end. Each of the lugs 27 has a length such that, when it is pivoted to an upright position, it extends through the associated slot 26 in the cover 20. Nuts 29 are respectively threadedly engageable with the hold-down lugs 27 firmly to clamp the cover 20 in its closed position, illustrated in the drawings.

The cover 20 is adapted to be pivotally moved between the illustrated closed position and an open position (not shown) by a hinge assembly 30, which includes a manway bracket 31 mounted on the manway structure 12 and a cover bracket 40 mounted on the cover 20, the brackets 31 and 40 being hingedly interconnected by a pivot pin in the nature of a hinge bolt 49. More particularly, the manway bracket 31 includes a base wall 32 having the outer end thereof upturned to define an upstanding lip 33, and a pair of substantially parallel side walls 34 respectively fixed to the base wall 32 and the lip 33 at the opposite sides thereof. Each of the side walls 34 is provided with an upstanding pivot ear 35, the ears 35 having aligned pivot bores (not shown) formed therethrough. The side walls 34 have vertical end edges 36 which are fixed to the outer surface of the manway cylindrical wall 14, as by welding, and the base wall 32 has an end edge 37 which is arcuately concave so as to fit matingly against the manway cylindrical wall 14 and is also fixed thereto as by welding. The upper edges of the side walls 34 inboard of the ears 35 define substantially coplanar bearing surfaces 38 (FIG. 2).

The cover bracket 40 also includes a pair of substantially parallel side walls 41 which are dimensioned to be disposed in use, respectively just inboard of the manway bracket side walls 34. Each of the side walls 41 has a pivot ear 42 with aligned pivot bores (not shown) therethrough. Each of the side walls 41 is fixed to the cover 20, as by welding, or is cast unitary therewith and extends along the outer surface of the cover wall 21 to define elongated, tapered flanges 43 upstanding from the cover wall 21. The cover bracket 40 also includes a base wall 44 interconnecting the side walls 41 at their distal ends, the base wall 44 having a stepped configuration, including an upper portion 45, a step portion 46 and a lower portion 47. A stiffening web 48 extends from a location along the underside of the cover wall 21 radially outwardly of the flange 23 to the base wall 44 intermediate the side walls 41.

In use, the cover bracket 40 is adapted to fit inside the manway bracket 31 when the cover 20 is disposed in its closed position, with the bores through the pivot ears 35 and 42 being coaxially aligned for receiving therethrough the hinge bolt 49, hingedly to interconnect the cover 20 and the manway structure 12 for pivotal movement of the cover 20 between its open and closed positions about the axis of the hinge bolt 49, all in a known manner. Preferably, the hinge bolt 49 has an enlarged head **49*a*** at one end and is externally threaded at its opposite end.

The hinge assembly 30 also includes a balancing mechanism 50, constructed in accordance with the present invention. The balancing mechanism 50 includes a pair of bushings 51 and 51A which are constructed as mirror images of each other. Each of the bushings 51 includes a cylindrical solid body 52 provided at one end thereof with a radially outwardly extending annular flange 53 and having a cylindrical axial bore 54 therethrough provided at the flanged end thereof with an enlarged-diameter counterbore 55. The bore 54 is dimensioned to freely receive therethrough the hinge bolt 49. The balancing mechanism 50 also includes a pair of washers 56 which are fitted over the hinge bolt 49 and respectively abut the outer surfaces of the pivot ears 35 of the manway bracket 31. In assembly, the hinge bolt 49 is received through the bushing 51A, with its head **49*a* seated against the bottom of the counterbore 55. The hinge bolt 49 is then received through one washer 56, the pivot ears 35 and 42 and then through the other washer 56 and the bushing 51, until the bushings 51 and 51A abut the associated washers 56. Then a nut 58 is threadedly engaged with the distal end of the hinge bolt 49 until it abuts the base of the counterbore 55 to hold the assembly together. A cotter pin 59 is received through a radial bore through the threaded end of the hinge bolt 49 to prevent accidental removal of the nut 58**.

The balancing mechanism 50 also includes a pair of torsion springs 60 and 60A which are arranged as mirror images of each other. Each of the torsion springs 60 and 60A has a plurality of coils or turns dimensioned to fit coaxially over an associated one of the bushings 51 and 51A. Each of the springs 60 has a manway end 61 which is bent inwardly back along the outside of the coil, substantially parallel to the axis of the coils, the ends 61 having a length such that, when the springs 60 and 60A are respectively disposed on the bushings 51 and 51A, as illustrated in FIG. 3, the ends 61 respectively extend inwardly to a point where they nearly touch each other. The manway ends 61 are respectively received in opposite ends of a tubular sleeve 62, which has a length sufficient to extend outboard of the side walls 34 of the manway bracket 31. Each of the torsion springs 60 also has a cover end 63 which projects tangentially from the spring coils generally orthogonal to the manway ends 61, the ends 63 respectively extending along the outside of the cover bracket flanges 43. The ends 63 respectively have sleeves 64 fitted thereover and are retained in eyebolts 65. More specifically, two eyebolts 65 are respectively received through complementary bores in the cover bracket flanges 43, with washers 66 being respectively disposed on each side of each flange 43. Each eyebolt 65 has an enlarged eye 67 at one end which freely slidably receives therethrough the associated torsion spring end 63 and its associated sleeve 64. The inner ends of the eyebolts 65 are externally threaded for engagement with associated nuts 68 to securely mount the eyebolts 65 in place. Cotter pins 69 may be received in radial bores in the threaded ends of the eyebolts 65 to prevent accidental removal of the nuts 68.

In assembly, it will be appreciated that the torsion springs 60 and 60A are, respectively, fitted over the bushings 51 and 51A prior to their assembly with the hinge bolt 49. When the balancing mechanism 50 is assembled, the bushing flanges 53 prevent the torsion springs 60 and 60A from moving axially off the ends of the bushings 51 and 51A. The torsion springs 60 and 60A are arranged and configured so that they resiliently urge the cover 20 toward its open position with a predetermined force, which is insufficient in itself to move the cover 20, but which serves to reduce the manual force which must be exerted by an operator in lifting the cover 20 to its open position. In this regard, it will be appreciated that the eyebolts 65 cooperate to anchor the cover ends 63 of the torsion springs to the cover bracket 40, effectively preventing any pivotal movement of the torsion spring ends 63 relative to the cover bracket 40 while accommodating a slight reciprocating sliding movement thereof in the eyes of the eyebolts 65 as the cover 20 is moved between its open and closed positions. The sleeve 62 cooperates with the manway ends 61 of the torsion springs 60 and 60A to anchor them to the manway bracket 31. More specifically, the sleeve 62 spans and engages the bearing surfaces 38 of the manway bracket 31 beneath the stiffening web 48 of the cover bracket 40. This effectively prevents pivotal movement of the manway ends 61 relative to the manway bracket 31, since the manway ends 61 are resiliently urged toward the bearing surfaces 38.

It is a significant aspect of the invention that the balancing mechanism 50 does not require that any openings be formed in the pressure vessel 10 or that any additional weldments be made thereto. More specifically, no such openings need be formed in or weldments need be made to the pressure wall 21 of the cover 20 or the cylindrical wall 14 of the manway structure 12. The balancing mechanism 50 is disposed entirely externally of the manway structure 12 and the cover 20. Furthermore, it will be appreciated that the balancing mechanism is of simple and economical construction and can readily be retrofitted to an existing hinge assembly by simply substituting the elongated hinge bolt 49 for the standard hinge bolt. The upper portion 45 of the cover bracket base wall 44 is disposed so as to bear against the upper edge of the manway bracket lip 33 to limit the opening movement of the cover 20 and support the cover 20 in its open position, all in a known manner.

When the cover 20 is in its open position, the balancing mechanism 50 will continue to urge it toward that position, although with a lesser force than it exerts when the cover 20 is in the closed position. The force exerted by the balancing mechanism 50 increases as the cover 20 is lowered back to its closed position, serving to counterbalance the weight of the cover 20 and thereby assist in both closing and opening thereof. In a constructional model of the invention, the torsion springs 60 and 60A are such that they will exert a force sufficient to reduce the overall manual lifting force required to lift the cover 20 to a value less than the maximum permitted by applicable operating procedures which, in typical applications, is approximately 50 pounds.

From the foregoing, it can be seen that there has been provided an improved balancing mechanism for a vessel manway cover which is mounted entirely externally and requires neither holes to be formed in nor welds to be applied directly to the pressurized walls of a vessel, the balancing mechanism being of simple, compact and economical construction and being adapted for easy retrofitting to existing hinge structures.

I claim:

1. A balancing mechanism for a cover for a manway defined by a portion of a pressurized vessel wall, wherein the cover is pivotally mounted for movement between open and closed positions relative to the manway by externally mounted hinge structure which includes a hinge pin coupling external first and second hinge brackets respectively on the cover and the portion of the pressurized vessel wall, said balancing mechanism comprising: torsion spring mechanism carried by the hinge structure and having first and second end structures, first coupling mechanism disposed externally of the manway and the cover and cooperating with one of said end structures and with the first hinge bracket to cause said one end structure and the cover to move together, and second coupling mechanism disposed externally of the manway and the cover and cooperating with the other of said end structures and with the second hinge bracket effectively to prevent movement of said other end structure in response to movement of the cover, said torsion spring mechanism being oriented so as to resiliently urge the cover toward the open position thereof.

2. The balancing mechanism of claim 1, wherein said torsion spring mechanism is disposed substantially coaxially with the hinge pin.

3. The balancing mechanism of claim 1, wherein said first and second end structures are generally orthogonal.

4. The balancing mechanism of claim 1, wherein said first coupling mechanism includes means engaging said one end structure so as to effectively prevent pivotal movement thereof relative to the first hinge bracket.

5. The balancing mechanism of claim 4, wherein said first coupling mechanism includes means connected to the first hinge bracket and defining an aperture through which said one end structure is slidably received.

6. The balancing mechanism of claim 1, and further comprising bushing means carried by the hinge pin and coaxially received through said torsion spring mechanism for supporting same.

7. The balancing mechanism of claim 6, wherein said bushing means includes retaining means for preventing axial displacement of said torsion spring mechanism relative to said bushing means.

8. The balancing mechanism of claim 1, wherein said second coupling mechanism includes a bearing surface on the second hinge bracket engageable with said other end structure for preventing movement thereof.

9. A balancing mechanism for a cover for a manway defined by a portion of a pressurized vessel wall, wherein the cover is pivotally mounted for movement between open and closed positions relative to the manway by externally mounted hinge structure which includes a hinge pin coupling external first and second hinge brackets respectively on the cover and the portion of the pressurized vessel wall, said balancing mechanism comprising: a first torsion spring disposed coaxially with the hinge pin toward one end thereof outboard of the hinge brackets, a second torsion spring disposed coaxially with the hinge pin adjacent to the other end thereof outboard of the hinge brackets, each of said torsion springs having a cover end and a vessel wall end, first coupling mechanism disposed externally of the manway and the cover and cooperating with said cover ends of said torsion springs and with the first hinge bracket to cause said cover ends and the cover to move together, and second coupling mechanism disposed externally of the manway and the cover and cooperating with said vessel wall ends of said torsion springs and with the second hinge bracket effectively to prevent movement of said vessel wall ends in response to movement of the cover, said torsion springs being oriented so as to resiliently urge the cover toward the open position thereof.

10. The balancing mechanism of claim 9, and further comprising first and second bushings respectively carried by the hinge pin adjacent to the opposite ends thereof and respectively coaxially received through said first and second torsion springs for supporting same.

11. The balancing mechanism of claim 10, wherein each of said bushings includes terminal flange means for preventing substantial axial displacement of said torsion springs relative to said bushings.

12. The balancing mechanism of claim 9, wherein each of said vessel wall ends is disposed substantially parallel to the hinge pin.

13. The balancing mechanism of claim 12, and further comprising a cylindrical sleeve coaxially receiving therein each of said vessel wall ends.

14. The balancing mechanism of claim 9, wherein each of said cover ends is disposed generally orthogonal to the hinge pin.

15. The balancing mechanism of claim 14, wherein said first coupling mechanism includes means fixed to the first hinge bracket and defining two apertures for respectively slidably receiving therethrough said cover ends of said torsion springs.

* * * * *